United States Patent [19]

DiVito et al.

[11] Patent Number: 4,887,323

[45] Date of Patent: Dec. 19, 1989

[54] BATHTUB HAND RAIL

[75] Inventors: Fred DiVito, Asharoken; Christopher I. Beal, Lindenhurst, both of N.Y.

[73] Assignee: Lumex, Inc., Bay Shore, N.Y.

[21] Appl. No.: 272,636

[22] Filed: Nov. 17, 1988

[51] Int. Cl.[4] ..... A47K 3/022

[52] U.S. Cl. ..... 4/577; 4/511; 4/559

[58] Field of Search ..... 4/577, 576, 559, 496, 4/504, 511, 605; 269/3; 294/16, 103.1, 104

[56] References Cited

U.S. PATENT DOCUMENTS

| | | | |
|---|---|---|---|
| 2,931,051 | 4/1960 | Sparling | 4/577 |
| 2,940,085 | 6/1960 | Hussey | 4/577 |
| 3,414,910 | 12/1968 | Provi et al. | 4/577 |
| 3,448,468 | 6/1969 | Murcott | 4/577 |
| 3,968,524 | 7/1976 | Zentman | 4/577 |
| 4,417,361 | 11/1983 | Smith | 4/577 |

FOREIGN PATENT DOCUMENTS

| | | | |
|---|---|---|---|
| 370893 | 9/1963 | Switzerland | 4/577 |

OTHER PUBLICATIONS

Frohock-Stewart promotional literature showing Models 620, 100, 1010 bathtub security rails.

Invacare promotional literature showing Model 1707 bathtub safety rail.

Kendall-Futuro promotional literature showing bathtub safety rails.

Garelick promotional literature showing bathtub grab bar model no. 90079.

Temco Home Health Care Products promotional literature showing bathtub rail model no. 2032.

Frohock-Stewart promotional literature showing Models 1200, 710 and 700 bathtub security rails.

Lumex Division of Lumex, Inc. promotional brochure printed 11-87-7 showing Bathtub Safety Rails Model Nos. 6960 & 6961 entitled "Bathroom Safety".

Lumex Division of Lumex, Inc. brochure 3-84-30M dated 1984 showing Bathtub Safety Rails Models 6960 & 6961.

Guardian Sunrise Medical promotional literature showing tub grab bar Model 98005, dated 1987.

*Primary Examiner*—Henry K. Artis

*Attorney, Agent, or Firm*—Davis Hoxie Faithfull & Hapgood

[57] ABSTRACT

A bathtub hand rail having a molded plastic body with a hand-grip portion and a lower portion. A lip extends downwardly from the lower portion, and has a first surface for placement against a first side surface of the bathtub side wall. A second surface of the lip has a recess therein with a semicircular top wall, two vertical side walls, a bottom wall and a back wall. Extending through the lower portion of the body is a longitudinal rectangular slot. Received within the slot is a horizontal arm of a clamp arm assembly. A vertical arm of the clamp arm assembly has pivotally attached to it a press plate for placement against a second side surface of the bathtub side wall. The horizontal arm and the vertical arm are attached to one another. A threaded rod, which is pivotally attached to a locking handle at a head portion, is threaded into threaded receiving means in the horizontal arm through an orifice in the recess. As the locking handle is rotated, the threaded rod is threaded further into the horizontal arm and the press plate is drawn securely up against the second side surface of the bathtub side wall. The locking handle is then pivoted down into a seated position in the recess. An over-center clamping mechanism arrangement insures that the locking handle remains seated in the recess. Because the width and height (length) dimensions of the locking handle are less than comparable dimensions of the recess, the locking handle cannot rotate when seated in the recess, and therefore the threaded rod cannot be turned.

14 Claims, 7 Drawing Sheets

42
44
40

3
1
20
24
24b
29
26a
23
24a
2
26
22
B
B
16
30
14c
12
14a
19
46
32
55a
55b
55
70
15
17
11
14
18
14b
55a
57a
14d
17a
52
17b
50
11

BATHTUB HAND RAIL

FIELD OF THE INVENTION

This invention relates to an improved bathtub hand rail with a clamping mechanism for securing the hand rail to bathtub side walls of varying widths.

BACKGROUND OF THE INVENTION

It is well known in the health care field that bathtubs present a safety hazard to any person in a weakened or infirm condition. Oftentimes, serious injury results when a person slips and falls while entering or exiting the bathtub. Broken bones and the like often result from such accidents, particularly for the elderly.

Bathtub hand rails which are secured to the side wall of a bathtub have been used for many years. The user secures the hand rail to the side wall of the bathtub by use of a clamping mechanism of some kind. To enter or exit the bathtub, the user grasps a hand-grip portion of the hand rail for support. These hand rails are generally adjustable to fit a variety of bathtub side-wall thicknesses.

Many existing bathtub hand rails are made primarily of bent or rolled steel. A steel hand rail, depending on the amount of steel used, can be heavy, requiring an unacceptably large effort by an elderly or infirm person to position and secure the hand rail to a bathtub side wall. Also, a heavy steel bathtub hand rail is not easy to transport, an important consideration for those situations when the user is travelling overnight outside the home.

Another disadvantage of an all-steel hand rail is that the user may be seriously injured if he or she bumps into or hits against a steel piece. For example, a serious injury can result if a person hits his or her head against an upstanding steel hand-grip portion of a bathtub hand rail.

Many existing hand rails utilize clamps to secure the hand rail to the side wall of the bathtub. For example, a knob attached to a screw is used to tighten the clamps against the surfaces of the bathtub side wall. Rubber or the like is interposed between the clamps and the tub in order to prevent marring or scratching of the tub side wall.

The user must turn such a knob as tightly as possible to insure that the hand rail is secured to the bathtub side wall. The user always is concerned whether in fact he or she has turned the locking knob far enough. Oftentimes, that extra "bite" on the clamp requires the user to exert a large rotational force on the knob.

Also, many existing hand rails have protruding parts which obstruct the user in moving in and out of the bathtub. These protrusions can also be a hazard to a person walking in the area around the outside of the bathtub. Protruding parts, such as knobs or handles, also present a "cluttered" appearance, detracting from the hand rail's attractiveness.

There is also some risk that a protruding knob could be inadvertently rotated by a person bumping into it. This could result in a lessening of the clamping force of the hand rail on the bathtub side wall.

There remains a need for a light-weight, easy to install hand rail which is quickly adjustable to different size tub side walls. Such a hand rail must offer the ultimate in safety and security to the user, and have an easy to use clamping mechanism.

SUMMARY OF THE INVENTION

The bathtub hand rail of the present invention has a body with a hand-grip portion and a bottom portion. Extending downwardly from the bottom portion is a lip, a first surface of which bears against a first side surface of a bathtub side wall. A second surface of the lip has a recess therein. Extending through the bottom portion of the body is a longitudinal slot.

A clamp arm assembly comprising a press plate is connected to a locking handle through the longitudinal slot wherein rotation of the locking handle draws the press plate against a second side surface of the bathtub side wall, thereby securing the hand rail to the bathtub side wall.

Once secured to the bathtub side wall, the locking handle is seated into the recess by means of an over-center clamping mechanism.

The clamp arm assembly has a horizontal and vertical arm, which are attached to one another. The horizontal arm extends into the longitudinal slot of the body. The press plate is pivotally attached to the vertical arm. A threaded rod, attached at a head portion to the locking handle, is threaded into threaded receiving means in a first end of the horizontal arm. Rotation of the locking handle causes the threaded rod to thread into the threaded receiving means thereby drawing the press plate toward the second side surface of the bathtub side wall and securing the hand rail to the bathtub side wall.

The locking handle has width and height (length) dimensions less than comparable dimensions of the recess so that the locking handle can be seated in the recess. When seated in the recess, the dimensions of the locking handle and the recess are such that the locking handle cannot rotate.

The body of the hand rail is made of a high density polyethylene material and is rotomolded. In cross-section, the hand-grip portion of the body has a first rounded portion for placement against the palm, two substantially linear portions extending from the first rounded portion, and a second rounded portion connected between the ends of the two substantially linear portions.

DETAILED DESCRIPTION OF THE INVENTION

Figures 1, 10:
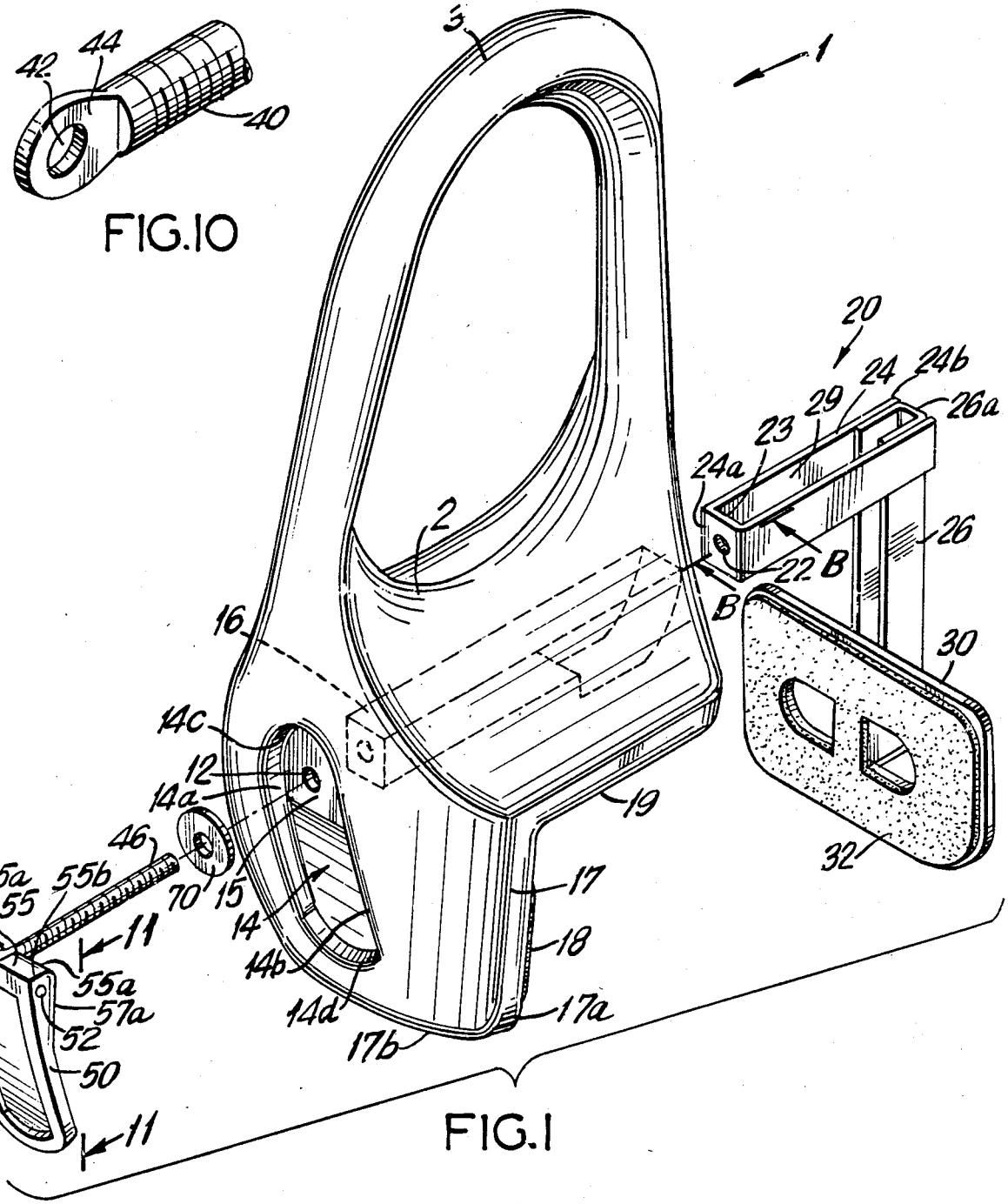
FIG. 1 is an exploded view in perspective of the components of the bathtub hand rail of the present invention, including a molded plastic body, a locking handle, a threaded rod and a clamp arm assembly, wherein a longitudinal rectangular slot within a bottom portion of the plastic body is shown on dotted line.
FIG. 10 is an enlarged perspective view of a head portion of the threaded rod shown in the prior figures.

Reference is made to the drawing figures where the various components of a hand rail 1 of the present invention are shown.

The hand rail 1 has a molded plastic body 2, which, in the preferred embodiment, is high density polyethylene ("HDPE") sold under the designation NORCHEM #5305. This material is commercially available from a number of suppliers.

NORCHEM #5305 is softer to the touch than steel, yet has enough texture to assist the user when the user grasps a hand-grip portion 3 of the hand rail 1. NORCHEM #5305 also is light weight, making the entire hand rail 1 of the present invention significantly easier to lift and move than all-steel bathtub hand rails. Also, because HDPE is more resilient than steel, there is less a possibility of injury if the user hits or bangs into the HDPE material.

With all of these advantages, NORCHEM #5305 still has the strength necessary to support the weight of the user. Also, the percentage of elongation is high enough such that it is virtually impossible under normal use for there to be a catastrophic failure, i.e., under normal use HDPE will not develop a crack immediately when stressed beyond acceptable limits.

Other thermoplastics could be used for the plastic body 2, depending on the characteristics of the material.

In the preferred embodiment, the plastic body 2 is molded in one piece, though multiple pieces may be utilized. The plastic body 2 is molded in the preferred embodiment using the rotomold process.

The user grabs onto the hand-grip portion 3 of the plastic body 2 for support while entering and exiting the bathtub. The hand grip 3 is ergonomically designed, having a cross-section as shown in FIG. 5A. The hand grip 3 has a first rounded portion 3*a* adapted to face the palm of the user, and two substantially linear portions 3*b* and 3*c* extending from either end of the first rounded portion 3*a*. The portions 3*b* and 3*c* meet at a second rounded portion 3*d*, as shown in FIG. 5A.

The curvature of the first rounded portion 3*a* conforms generally to the curvature of the human palm when gripping the hand rail 1. The substantially linear portions 3*b* and 3*c* match the substantially linear shape of segments of the human finger, for example that segment of the finger between the base of the finger and the knuckle. FIG. 5A shows an example of a human hand grasping the hand grip 3, wherein the palm rests against the first rounded portion 3*a* and a linear segment of at least the index finger is flush against the substantially linear portion 3*b* of the hand-grip 3.

In the preferred embodiment, the first rounded portion 3*a* has a radius of curvature of approximately 13/16", the linear portions 3*b* and 3*c* are each approximately 11/16" in length and the rounded portion 3*d* has a radius of curvature of approximately 7/16". It should be noted that FIG. 5A does not show the portions 3*a*–3*d* to scale.

The structure used for securing the hand rail 1 to a bathtub side wall 60 will now be described.

A locking handle 50, a threaded rod 40 and a clamp arm assembly 20 interengage with the plastic body 2 to secure the hand rail 1 to the bathtub side wall 60. By adjusting the position of the rod 40, the user can secure the hand rail 1 to bathtubs having varied side-wall thicknesses, such as the two bathtub side walls designated as element 60 in FIGS. 4 and 5.

Figure 4:
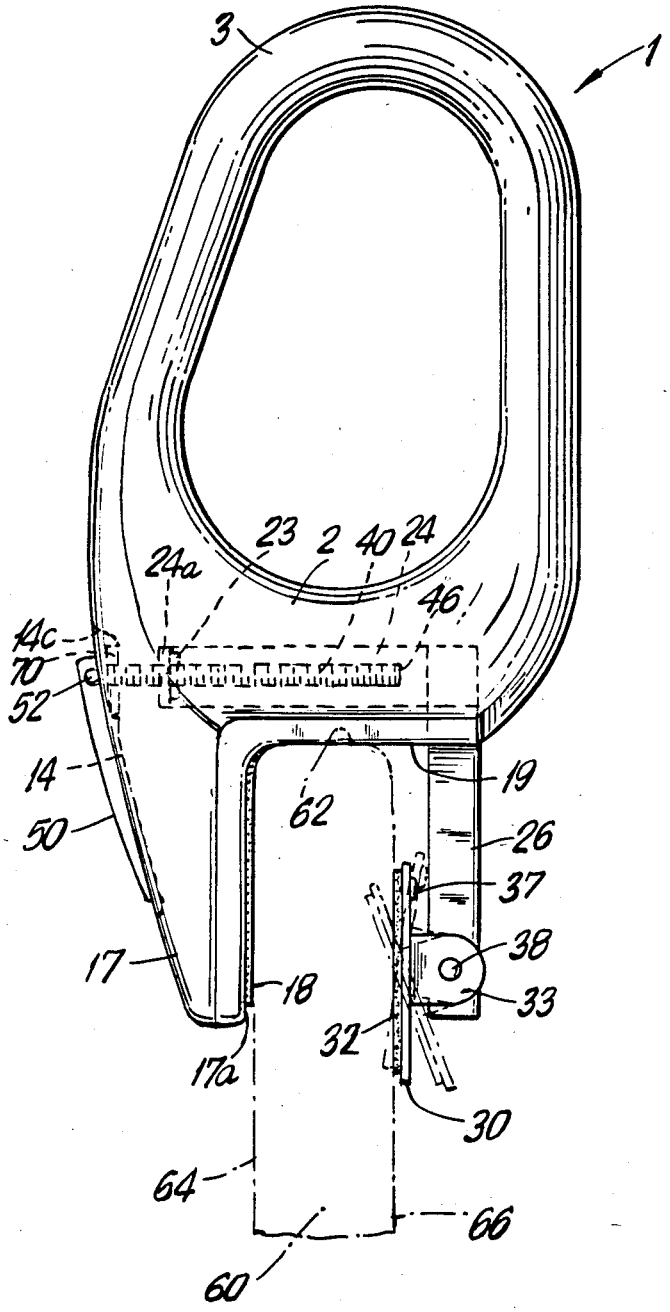
FIG. 4 is a side elevational view of the hand rail of FIG. 2 secured to a first bathtub side wall having a first thickness, wherein the interengagement of the clamp arm assembly and the threaded rod in the longitudinal rectangular slot in the plastic body is shown in dotted line.
Figure 5:
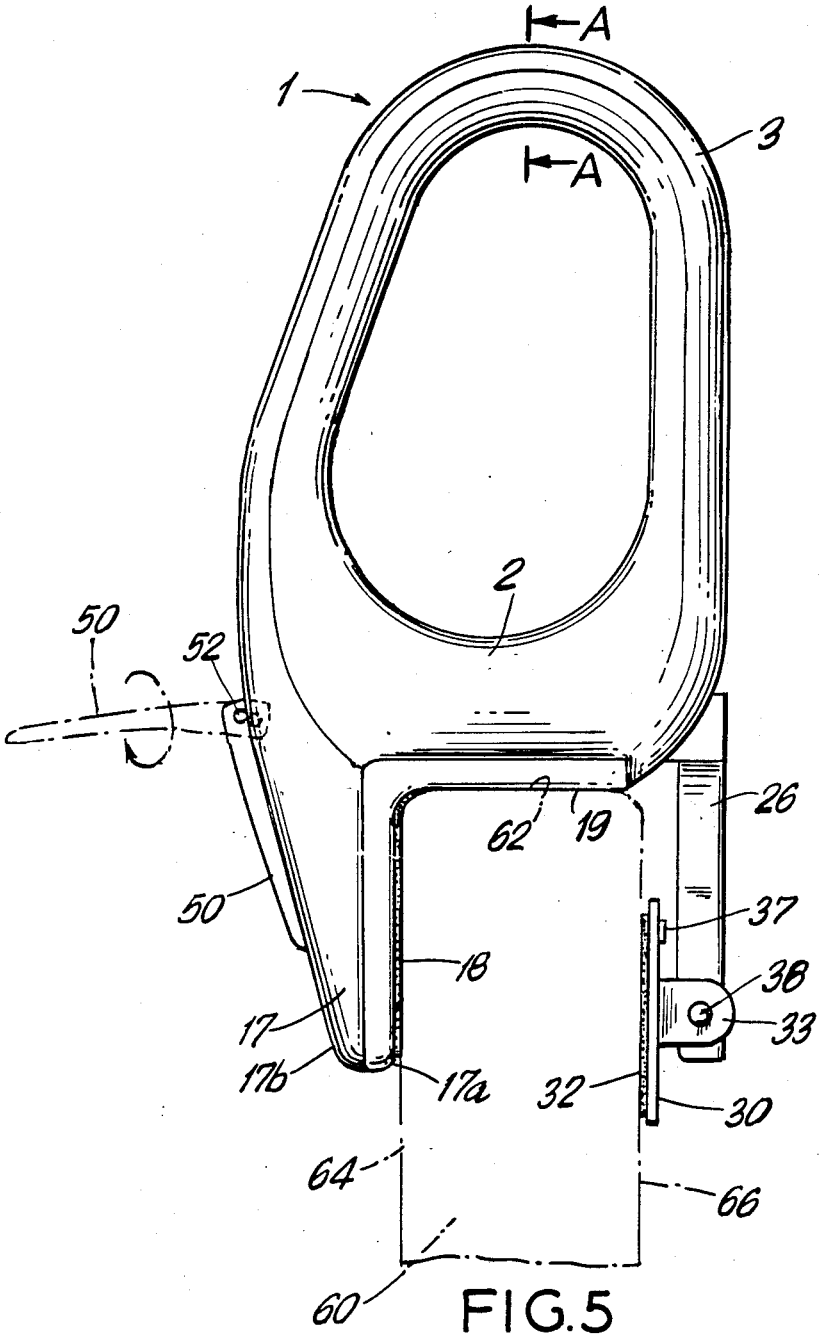
FIG. 5 is a side elevational view similar to FIG. 4 wherein the hand rail is secured to a second bathtub side wall of a second thickness.
Figure 5A:
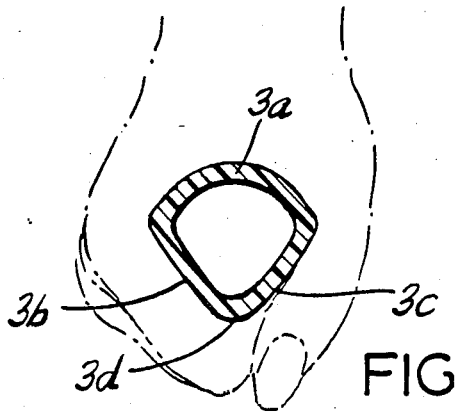
FIG. 5A is an enlarged view in section of a hand-grip portion of the plastic body along lines A—A of FIG. 5.

The bottom portion of the plastic body 2 is generally L-shaped in configuration, as seen in FIGS. 4 and 5. Downwardly extending lip 17 in the bottom portion of the plastic body 2, has a generally vertical first surface 17*a* and a sloped second surface 17*b*. Surface 17*a* has attached to it a rubber pad 18, which, as shown in FIGS. 4 and 5, presses against a first side surface 64 of the bathtub side wall 60 when the rail 1 is secured to the side wall 60. Any suitable material may be used for pad 18, so long as the pad 18 does not slip and does not scratch or mar the surface 64 of the bathtub side wall 60. In the preferred embodiment, pad 18 is made of rubber and is secured to surface 17*a* by adhesive.

The sloped surface 17*b* of the lip 17 has a recess 14 into which locking handle 50 is seated once the hand rail 1 is secured to the side wall 60, as described in more detail below in the section entitled ASSEMBLY AND OPERATION.

Horizontal surface 19 of plastic body 2 is at approximately a 90° angle to surface 17*a* of lip 17. Surface 19 rests on a top surface 62 of the bathtub side wall 60 when the hand rail 1 is secured to the side wall 60. As seen in FIGS. 4 and 5, a small portion at the top of pad 18 extends onto surface 19, accommodating the slightly curved joining of surface 64 and surface 62 of the bathtub side wall 60.

The depth of the locking handle 50 is only slightly greater than the maximum depth of the recess 14. Therefore, as best seen in FIGS. 4 and 5, when the hand rail 1 is secured to the bathtub side wall 60 and the locking handle 50 is seated in recess 14, the locking handle 50 extends only slightly in a lateral dimension out of lip 17. This enhances the aesthetic appearance of the hand rail 1, and also adds to the safety of the hand rail 1 in that there is no dangerous protrusion, as with knobs on some existing bathtub hand rails.

The width of recess 14 is slightly larger than the maximum width dimension of the locking handle 50. Similarly, the height or length of the recess 14 is greater than the maximum height or length of locking handle 50. This insures that locking handle 50 can fit into the recess 14.

The recess 14 is defined by two side walls 14*a* and 14*b*, a semicircular top end wall 14*c*, a bottom end wall 14*d* and a back wall consisting of a top back-wall portion 15 and a bottom back-wall portion 13.

The top back-wall portion 15 has a circular orifice 12. As described below, orifice 12 receives a threaded end 46 of the threaded rod 40. The top back-wall portion 15 is essentially vertical, i.e. does not have the slope of surface 17*b*. This allows for cam-type action of the locking handle 50 when the locking handle 50 is moved from the dotted line position shown in FIG. 5 to the solid line position shown in that figure. The top end wall 14*c* of the recess 14 is semicircular in configuration to allow the user to screw and unscrew the threaded rod 40 by rotating the locking handle 50 (in the manner shown by the arrow in FIG. 5) when the locking handle 50 is in the position shown in dotted line in FIG. 5. The importance of these features is described in the ASSEMBLY AND OPERATION section below.

The bottom back wall portion 13 of the recess 14 is sloped inwardly toward surface 17*a*, approximately matching the slope of surface 17*b* on lip 17.

The bottom end wall 14*d* of the recess 14 is curved in the present embodiment, but any shape of bottom end wall is appropriate, depending upon the shape of the bottom end of the locking handle 50.

The side walls 14*a* and 14*b* on the recess extend vertically from the semicircular top end wall 14*c* to the bottom end wall 14*d*. These side walls 14*a* and 14*b* prevent rotation of the locking handle 50 when the handle 50 is in the seated position within the recess 14. By preventing rotation of the locking handle 50, side walls 14*a* and 14*b* of the recess 14 insure that the hand rail 1 remains firmly secured to the bathtub side wall 60.

Figure 6:
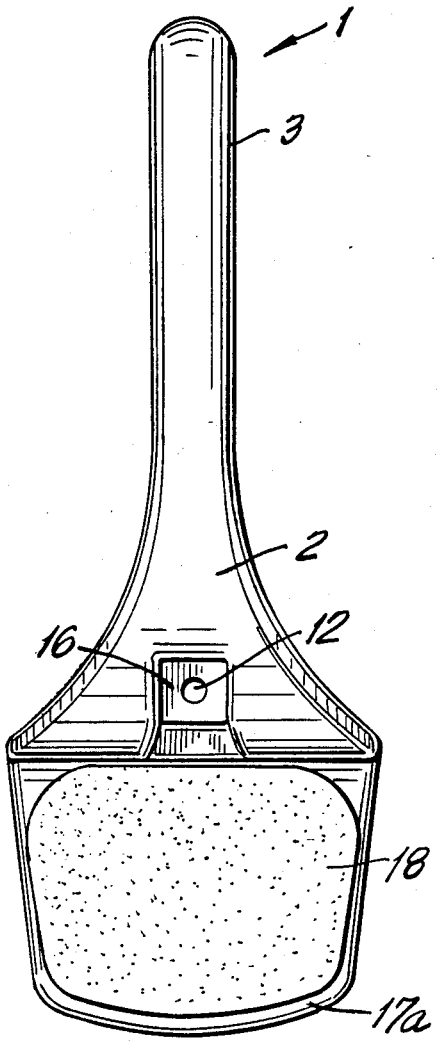
FIG. 6 is an end elevational view of the molded plastic body of the hand rail of the present invention.
Figure 8:
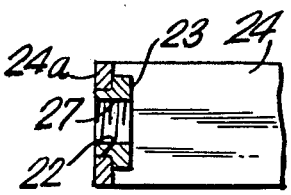
FIG. 8 is a side elevational view along lines B—B of FIG. 1 partially in section of a threaded nut secured to a horizontal arm of the clamp arm assembly.

Extending from orifice 12 through the lower portion of the plastic body 2 is a longitudinal rectangular slot 16, best seen in dotted line in FIG. 1 and also seen in FIG. 6. A horizontal arm 24 of the clamp arm assembly 20 is received into slot 16. The horizontal arm 24 has no top and bottom walls, and has a circular orifice 22 through a first end wall 24*a*. Threaded receiving means such as a threaded nut 23 is attached to the first end 24*a* by resistance welding or the like. The nut 23 has a laterally extending portion 27 which is adapted to receive the threaded end 46 of the rod 40. The threaded nut 23 and the first end 24*a* of arm 24 are shown in detail in FIG. 8.

As described below in the ASSEMBLY AND OPERATION section, the threaded end 46 of the threaded rod 40 passes through the circular orifice 12 in the plastic body 2, through the circular orifice 22 in the first end wall 24*a* of horizontal arm 24 and into the threaded portion 27 of nut 23. Since the horizontal arm 24 has an open interior space 29 as seen in FIG. 1, rod 40 extends into the interior space 29 as the threaded end 46 is screwed into the threaded nut 23.

Threads could be machined into the end 24*a* of arm 24, thereby making the threaded nut 23 unnecessary.

The structure of clamp arm assembly 20 will now be described in detail.

Assembly 20 is L-shaped, as best seen in FIGS. 1, 4 and 5, and consists of he horizontal arm 24 and a vertical arm 26, both preferably made out of steel. The amount of steel in the clamp arm assembly 20 does not make the hand rail 1 difficult to lift or move. By making the body out of HDPE, the overall weight of the hand rail 1 is significantly reduced compared to an all-steel hand rail.

A second end 24*b* of the arm 24 is attached to a first end 26*a* of the arm 26, such that arms 24 and 26 are at approximately a 90° angle to one another. In the preferred embodiment, ends 24*b* and 26*a* are resistance welded together, though other means of attachment such as bolts or the like may be used.

The side walls of the vertical arm 26 each have a circular orifice for receipt of a pin 38. Pin 38 is used to attach a press plate 30 to the vertical arm 26 in such a manner that the plate 30 can pivot to a limited degree, as shown in FIG. 4. Other means of attaching plate 30 to arm 26 may be used, so long as plate 30 can pivot to a limited degree.

Figure 3:
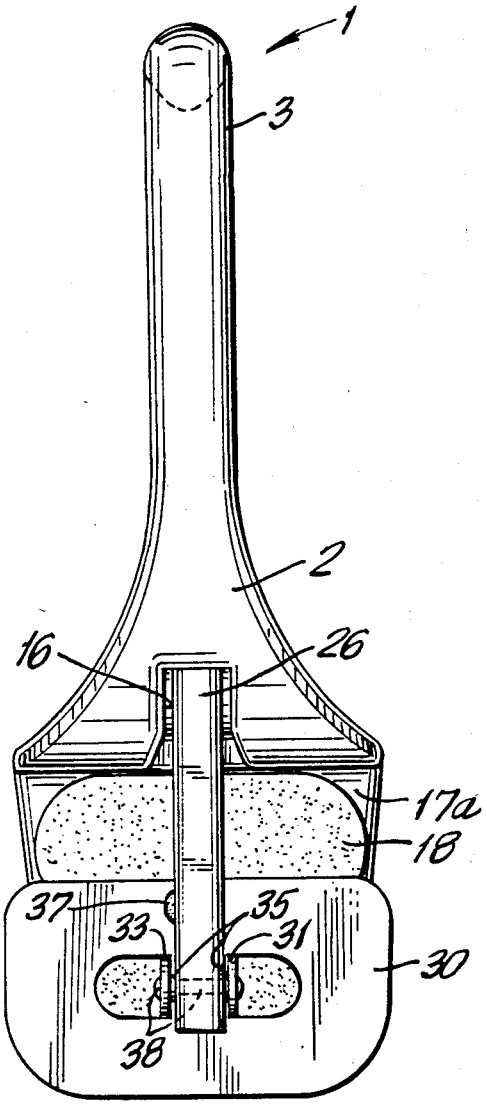
FIG. 3 is an end elevational view of the hand rail of FIG. 2.
Figure 7:
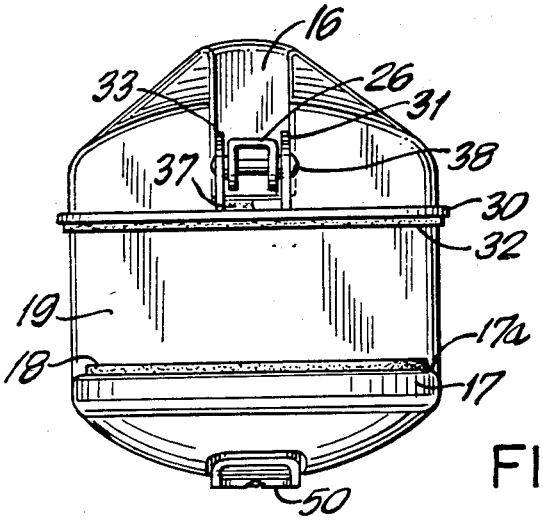
FIG. 7 is a bottom plan view of the hand rail of FIG. 3.

Press plate 30 is best seen in FIGS. 3, 4 and 7. U-shaped wings 31 and 35 extend from a first side of plate 30. As shown in FIG. 7, the configuration of wings 31 and 35 results in a U-shaped bracket structure. In the preferred embodiment, plate 30 and Wings 31 and 33 are a one-piece steel structure, with the wings 31 and 33 bent up out of the plate 30.

Each wing 31 and 33 has a circular orifice for receipt of pin 38. Plastic washers 35 are inserted between each wing and the respective side wall of arm 26 to insure that plate 30 is free to pivot, as shown by the various dotted line positions in FIG. 4. It is important that plate 30 be allowed a limited degree of pivoting to insure a secure fit of the hand rail 1 to any number of differently contoured bathtub side walls.

The first side of plate 30 also has a rubber bumper 37 attached to it by adhesive or the like. Bumper 37 prevents the steel in the plate 30 from hitting the steel of vertical arm 26 when the plate 30 rotates to the furthest rearward position shown in dotted line in FIG. 4. This protects plate 30 and arm 26 from scratches and the like.

Attached to a second side of the press plate 30 is a rubber pad 32. The rubber pad 32, as shown in FIGS. 4 and 5, presses against a second side surface 66 of the bathtub side wall 60 when the rail 1 is secured to the side wall 60. As with rubber pad 18, any suitable material may be used for pad 32, so long as the pad 32 does not slip and does not scratch or mar the surface 66 of the bathtub side wall 60. In the preferred embodiment, pad 32 is made of rubber and is secured to surface 30*b* by adhesive.

The locking handle 50 and the threaded rod 40 are best seen in FIGS. 1, 4, 9A–9C, 10, 11 and 12. In the preferred embodiment, the locking handle 50 is made of a rigid plastic such as Delrin® 500, but any number of other high-strength plastics or other materials are suitable. The threaded rod 40 is made of cold rolled steel and is zinc-plated in the present embodiment.

The top portion of the locking handle 50 has a top surface 55. A U-shaped cutout 58 interrupts the continuity of surface 55. The cutout 58 is adapted to receive a head 44 of the threaded rod 40. Surface 55 is flush against a washer 70 when the locking handle 50 is in the dotted line position shown in FIG. 5.

Figure 2:
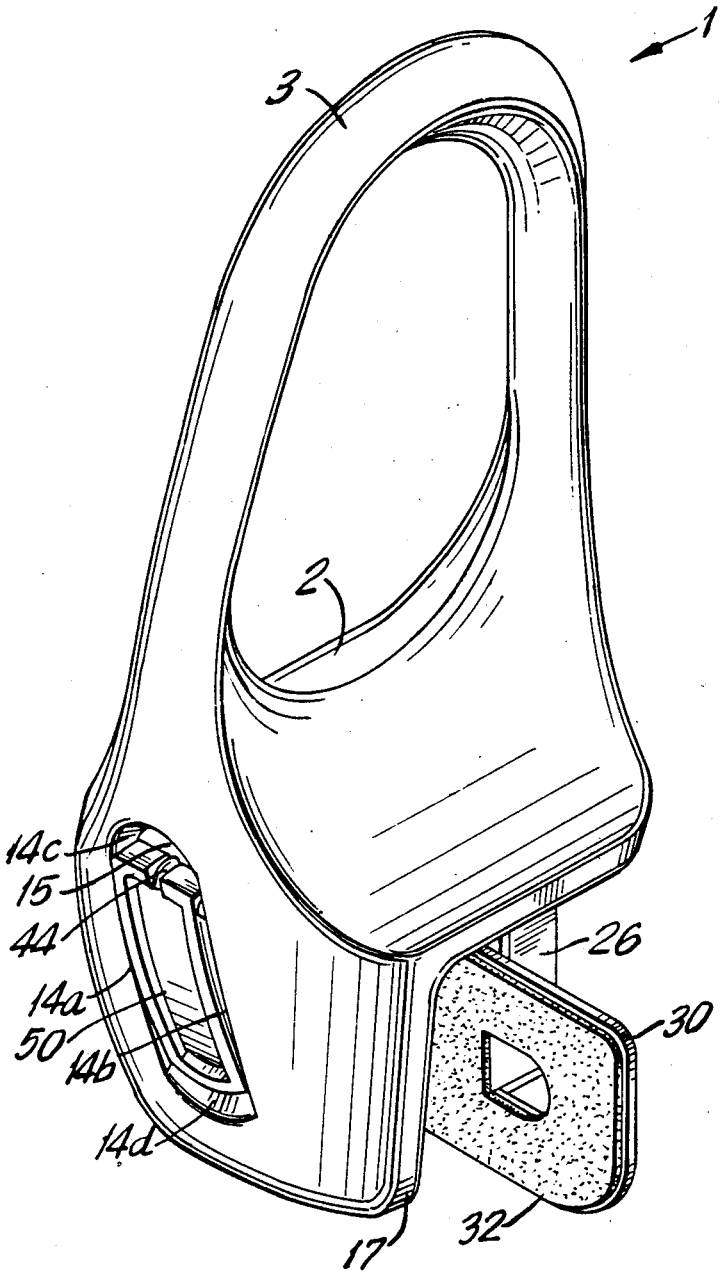
FIG. 2 is a perspective view of the bathtub hand rail of FIG. 1 with all components fully assembled.

The top portion of the handle 50 also has a surface 57 (FIG. 11) which is flush against washer 70 when the locking handle 50 is in the seated position in recess 14 (e.g., FIG. 2). The continuity of surface 57 is also interrupted by cutout 58.

Surfaces 55 and 57 are approximately at right angles to one another and are joined by slightly rounded edge 55*a*.

Figure 9A:
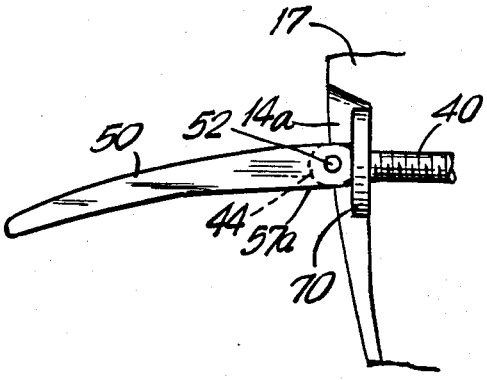
FIGS. 9A-9C show in partial section various positions of the locking handle of the hand rail of the present invention wherein the "over-center" locking procedure is shown.
Figure 9B:
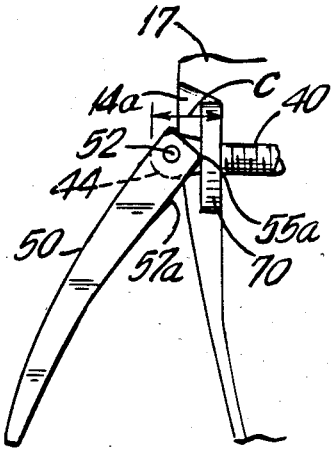

As shown in FIG. 9B, edge 55*a* bears against washer 70 at some point in the pivoting of handle 50 from the dotted line position shown in FIG. 5 to the seated or retained position of the handle 50 in recess 14.

This point where edge 55*a* bears against washer 70 is the "over-center" point where the maximum tension is exerted on the threaded rod 40. The locking handle 50 will snap into the recess 14 after passing beyond this "over-center" point.

The "over-center" feature when edge 55*a* bears into washer 70 is analogous to a camming action.

The top portion of the locking handle 50 also has a circular orifice 59 therethrough for receipt of a pin 52. Pin 52 secures the head 44 of the threaded rod 40 within the U-shaped cutout 58. Locking handle 50 is free to pivot on the axis of pin 52.

As seen in FIG. 10, the head 44 of the threaded rod 40 has a circular orifice 42 designed for receipt of the pin 52.

The interconnection of the locking handle 50, the pin 52 and the threaded rod 40 allows the user to lift the locking handle 50 to the position shown in dotted line in FIG. 5, and then rotate the locking handle 50 as shown by the arrow in FIG. 5 so as to screw the threaded rod 40 into the threaded nut 23, thereby drawing plate 30 toward surface 17*a*. This clamping action holds the hand rail 1 onto the bathtub side wall 60, as shown in FIGS. 4 and 5.

Figure 12:
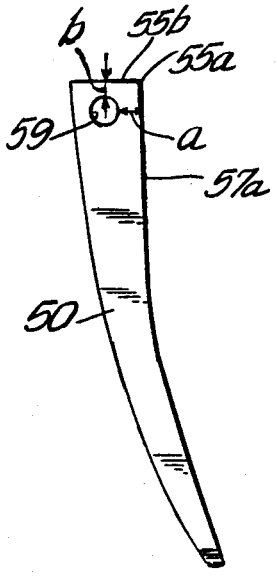
FIG. 12 is a side elevational view of the locking handle along lines 12—12 in FIG. 11.

Reference is now made to FIG. 12 where it is seen that the distance "a" between orifice 59 and the edge 57*a* of the handle 50 is greater than the distance "b" between the orifice 59 and the edge 55*b* of the handle 50. As explained in the ASSEMBLY AND OPERATION section below, this difference in distance between segments "a" and "b" provides an extra tensioning of the rod 40 using the mechanical advantage of a lever, without the need of a further rotation of the handle 50 in the manner shown by the arrow in FIG. 5.

In the preferred embodiment, the threaded end 46 of the rod 40 passes through the washer 70 prior to passing through the circular orifice 12 in the plastic body 2. Washer 70 is made of nylon, thereby offering a suitable surface for the camming action of handle 50. Washer 70 also acts to decrease the depth of the recess 14 at the top portion of the recess 14 so as to increase the tensioning of the rod 40.

ASSEMBLY AND OPERATION

The bathtub hand rail 1 of the present invention is assembled and secured to the bathtub side wall in the following manner.

The user first takes the fully assembled clamp bar assembly 20 and inserts the first end 24*a* of bar 24 into the longitudinal rectangular slot 16 in the plastic body 2. Bars 24 and 26, nut 23, plate 30, pad 32 and bumper 37 of the clamp bar assembly 20 are pre-assembled in the manner previously described.

The user then inserts the threaded end 46 of the rod 40 through the orifice in washer 70, through orifice 12 in plastic body 2, and finally through orifice 22 into the threaded portion 27 of threaded nut 23 on arm 24. In the preferred embodiment, the locking handle 50 and the threaded rod 40 are already pivotally attached to one another by pin 52 in the manner previously described.

The user lifts the locking handle 50 to the position shown in dotted line in FIG. 5, and then rotates handle 50 as shown by the arrow in FIG. 5, thereby threading rod 40 into nut 23. Because the top end wall 14*c* of the recess 14 is semicircular in shape, the handle 50 can rotate a full 360° without obstruction. The more the user rotates the locking handle 50 in a clockwise direction, the further the threaded rod 40 will thread into the interior space 26 in the horizontal arm 24.

The user now takes the hand rail unit 1 and lowers it over the top surface 62 of the side wall 60 of the bathtub, with pad 18 flush against surface 64. To secure the hand rail 1 to the side wall 60, the user rotates locking handle 50 clockwise until the rubber pad 32 on press plate 30 pushes against the surface 66 on side wall 60. This places the threaded rod 40 under tension. Rotating the locking handle 50 in a clockwise direction increases the tension on rod 40 and further causes pads 18 and 32 to securely hold the hand rail 1 against surfaces 64 and 66, respectively, on the side wall 60. The hand rail 1 is therefore clamped on the bathtub side wall 60.

Figure 9C:
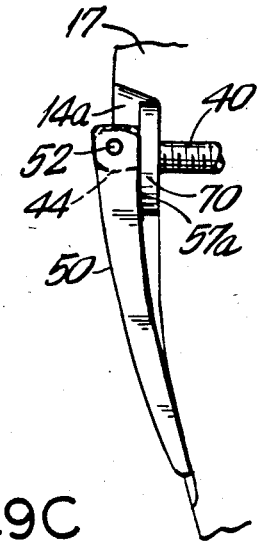
Figure 11:
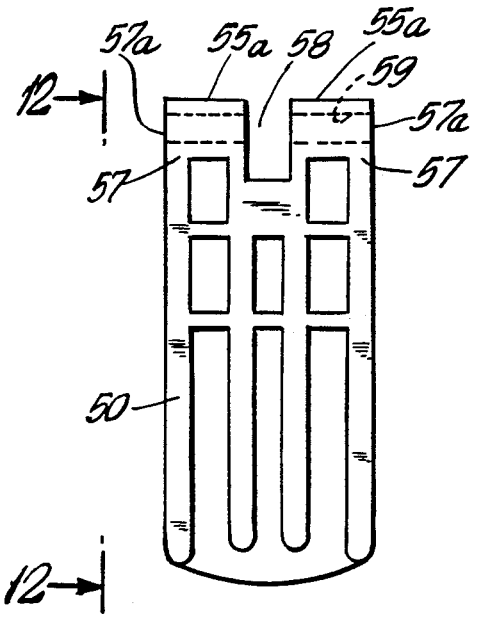
FIG. 11 is an enlarged end elevational view in isolation of the back side of the locking handle along lines 11—11 in FIG. 1.

When the handle 50 has been tightened sufficiently such that the hand rail 1 cannot be removed from the side wall 60, the user pivots the locking handle 50 from the dotted line position shown in FIG. 5 to the seated or retained position in the recess 14 shown in FIGS. 2, 4 and 5. FIGS. 9A–9C show in schematic form three positions of the locking handle 50 as it is pivoted from the dotted line position of FIG. 5 (FIG. 9A) to the seated or retained position in recess 14 (FIG. 9C). The side wall 14*b* of recess 14 is broken away in FIGS. 9A–9C in order to show more fully the pivoting of the locking handle 50.

As handle 50 pivots from the position shown in FIG. 9A to the position shown in FIG. 9C, rounded edge 55*a* bears against the surface of washer 70 (or the back wall 15 of recess 14 if no washer is used). At some point in the pivoting of locking handle 50, represented schematically in FIG. 9B, the head 44 of threaded rod 40 is displaced laterally out of lip 17 a maximum distance designated as "c" on FIG. 9B.

This displacement of the threaded rod 40 occurs because of eccentric pivoting, wherein the handle 50 pivots both on the axis of pin 52 and on the eccentric axis of edge 55*a*.

The displacement of rod 40 to the maximum distance "c" places the maximum tension on rod 40 for any of the possible positions of the handle 50 between the position shown in FIG. 9A and the position shown in FIG. 9C. This FIG. 9B position is the "over-center" point, as that term is understood by one with ordinary skill in the art.

The practical effect of an "over-center" point is that once that point is passed, the locking handle 50 will snap down into recess 14 to the seated or retained position shown in FIG. 9C. This snap down occurs because, once the "over-center" point is reached, the rod 40 will always try to force the handle 50 to move from a position which results in maximum tensioning of the rod 40 (FIG. 9B) to a position which results in less tensioning of the rod 40 (FIG. 9C).

The combination of the recess 14, the locking handle 50, and the threaded rod 40 as described above can be viewed as an over-center clamping mechanism.

This "over-center" locking feature insures hat the locking handle 50 is securely seated in the recess 14. Once locking handle 50 is seated in recess 14, the side walls 14*a* and 14*b* of the recess 14 prevent handle 50 from rotating, thereby preventing rod 40 from threading out of nut 23. Rod 40 cannot turn so long as locking handle 50 cannot rotate.

The pivoting of locking handle 50 as described above is analogous to a camming action, with all of the benefits thereof.

The "over-center" feature of locking handle 50 prevents the handle 50 from being moved out of the recess 14 unless the user lifts the locking handle 50 and overcomes the resistive camming force. Once the handle 50 passes the "over-center" point (FIG. 9B), it will snap up to at least the position shown in FIG. 9A.

So long as locking handle 50 is seated in recess 14, rod 40 cannot turn, and there can be no inadvertent or accidental loosening of the hand rail 1 on the side wall 60 of the bathtub. Therefore, there is no risk, as with exposed locking knobs on other hand rails, that the threaded rod 40 could be unscrewed. Further, applicants do not know of any prior art bathtub hand rail which has the over-center action of the locking handle 50.

As seen in the various figures, surface 55 is flush against washer 70 when the locking handle 50 is in the position shown in FIG. 9A and surface 57 is flush against washer 70 when the handle is in the position shown in FIG. 9C.

The point of maximum positional displacement of the rod 40 between the horizontal position of the handle 50 (FIG. 9A) and the retained position in the recess 14 of handle 50 (FIG. 9C) can be varied, and depends upon the shape of the surface and edges of the handle 50, the location of orifice 59 and the location and manner of attachment of the head 44 of the rod 40 to the locking handle 50. The manner of adjusting the "over-center" point is readily understood by one with ordinary skilled in the art. FIG. 9A–9C are shown for exemplary purposes only.

The configuration of the locking handle 50 also allows the user to tension the rod 40 an extra amount without having to rotate the handle 50.

In effect, the tensioning of rod 40 is greater when the locking handle 50 is in the seated position in the recess 14 (FIG. 9C) than when the locking handle 50 is in the horizontal position used for turning the threaded screw (FIG. 9A). The greater the tension on rod 40, the greater the clamping action of the hand rail 1 on the bathtub side wall 60.

Referencing FIG. 12, which is a side elevational view of the locking handle 50, it is seen that the distance "a" between the orifice 59 and the edge 57*a* is greater than the distance "b" between the orifice 59 and the edge 55*b*. Because of this arrangement, the head 44 of rod 40, which is connected to the handle 50 by pin 52 along the axis through orifice 59, will always be positionally displaced a greater distance when the handle 50 is in the FIG. 9C position than when the handle 50 is in the FIG. 9A position. If distance "b" shown in FIG. 12 were less than distance "a", then the tension on rod 40 would be less when the handle 50 is in the seated or retained position in the recess 14 than when it is in the raised position shown in FIG. 9A.

Because distance "a" is greater than distance "b" (FIG. 12) the user can "tighten down" the hand rail 1 using the mechanical advantage of a lever (the lever being the locking handle 50) rather than having to exert an additional rotational force on the handle 50. This arrangement has readily seen advantages over a knob, where the user has to exert a very high rotational force to give that final extra "bite" to the clamping screw.

To remove the hand rail 1 from the bathtub side wall 60, the user lifts the locking handle 50 to the dotted line position of FIG. 5, rotates the locking handle 50 counterclockwise, thereby unscrewing the rod 40 from the threaded nut 23. As rod 40 is unscrewed, the pad 30 can be moved away from the surface 66 and the unit 1 lifted off of the bathtub side wall 60.

It is readily seen that the light-weight bathtub hand rail 1 of the present invention may be used with a wide variety of bathtub side wall widths, such as the two bathtub side walls shown in FIGS. 4 and 5, that the securing of the unit 1 to the side wall may be done quickly, and that the over-center clamping mechanism insures a safe and secure hold on the side wall at all times.

It is understood that the present invention is not limited to the embodiment described above but is defined by the following claims.

We claim:

1. A bathtub hand rail for use on a bathtub side wall, the hand rail comprising:

a body comprising a hand-grip portion and a bottom portion, said bottom portion having a lip extending downwardly therefrom, and said bottom portion having a longitudinal slot extending therethrough, said lip having a first surface adapted for placement against a first side surface of the bathtub side wall, and a second surface having a recess portion;

a clamp arm assembly comprising a press plate adapted for placement against a second side surface of the bathtub side wall;

a locking handle having a maximum length dimension less than a minimum length dimension of the recess and having a maximum width dimension less than a minimum width dimension of the recess;

means for connecting the locking handle to the press plate through the longitudinal slot wherein rotation of the locking handle draws the press plate against the second side surface of the bathtub side wall, thereby securing the hand rail to the bathtub side wall; and means for seating the locking handle in the recess.

2. The bathtub hand rail of claim 1 wherein the clamp arm assembly also comprises a horizontal arm having a first end and a second end, the first end adapted for placement in the longitudinal slot, a vertical arm having a first end and a second end, means for attaching the second end of the horizontal arm to the first end of the vertical arm, and means for attaching the press plate to the vertical arm somewhere between the first end and the second end of the vertical arm.

3. The bathtub hand rail of claim 1 also comprising means for connecting the locking handle to the first end of the horizontal arm.

4. The bathtub hand rail of claim 1 wherein the body comprises rotomolded thermoplastic material.

5. The bathtub hand rail of claim 2 wherein the means for attaching the press plate to the vertical arm also comprises means for pivotally attaching the press plate to the vertical arm, thereby accommodating various bathtub side wall contours.

6. The bathtub hand rail of claim 3 wherein the means for connecting the locking handle to the first end of the horizontal arm comprises a first orifice in the recess;

a threaded rod having a head portion and a threaded end, the head portion having a second orifice;

a third orifice through a top portion of the locking handle;

a cutout portion on the locking handle adapted to receive the head of the threaded rod;

threaded receiving means on the first end of the horizontal arm; and a pin wherein the pin passes through the third orifice and the second orifice thereby pivotally connecting the locking handle and the threaded rod and wherein the threaded end of the threaded rod is threaded into the threaded receiving means on the first end of the horizontal arm.

7. The bathtub hand rail of claim 1 wherein the hand-grip portion in cross-section has a first rounded portion for placement against the palm of the hand, first and second substantially linear portions extending from the respective ends of the first rounded portion, and a second rounded portion, wherein the ends of the first and second substantially linear portions meet at the respective ends of the second rounded portion.

8. The bathtub hand rail of claim 1 wherein the recess is defined by first and second side walls, a semicircular top wall, a bottom wall and a back wall, wherein the first and second side walls extend from the top wall to the bottom wall and prevent rotation of the locking handle when the locking handle is seated in the recess.

9. The bathtub hand rail of claim 6 wherein a top portion of the locking handle has a top edge and a first side edge, and wherein the distance between the third orifice and the top edge is less than the distance between the third orifice and the first side edge.

10. The bathtub hand rail of claim 6 also including means for increasing the tension on the threaded rod while the locking handle is pivoting and without rotating the locking handle.

11. The bathtub hand rail of claim 8 wherein a top portion of the back wall of the recess is essentially vertical and a bottom portion of the back wall of the recess is sloped toward the first surface of the lip.

12. The bathtub hand rail of claim 1 also comprising a first rubber pad and a second rubber pad, and means for attaching the first rubber pad to the first surface of the lip and means for attaching the second rubber pad to the press plate.

13. The bathtub hand rail of claim 1 wherein the means for seating the locking handle in the recess comprises an over-center clamping mechanism.

14. The bathtub hand rail of claim 1 wherein the bottom portion of the body has a horizontal surface at approximately a 90° angle to the first surface of the lip, the horizontal surface adapted for placement against a top side of the bathtub side wall.

* * * * *